US008297340B2

(12) United States Patent
Berthelet

(10) Patent No.: US 8,297,340 B2
(45) Date of Patent: Oct. 30, 2012

(54) METHOD OF PRODUCING DUCTILE IRON

(75) Inventor: Emmanuel Berthelet, Crepy-en-Valois (FR)

(73) Assignee: Foseco International Limited, Derbyshire (GB)

( * ) Notice: Subject to any disclaimer, the term of this patent is extended or adjusted under 35 U.S.C. 154(b) by 34 days.

(21) Appl. No.: 12/227,640

(22) PCT Filed: Jun. 22, 2007

(86) PCT No.: PCT/GB2007/002342

§ 371 (c)(1),
(2), (4) Date: Dec. 12, 2008

(87) PCT Pub. No.: WO2008/012492

PCT Pub. Date: Jan. 31, 2008

(65) Prior Publication Data

US 2010/0294452 A1 Nov. 25, 2010

(30) Foreign Application Priority Data

Jul. 25, 2006 (GB) ..... 0614705.2

(51) Int. Cl.
*B22D 27/00* (2006.01)
*C22C 37/00* (2006.01)
*C22C 37/04* (2006.01)

(52) U.S. Cl. ..... 164/55.1; 164/57.1; 164/58.1; 420/25; 420/578

(58) Field of Classification Search ..... 164/55.1, 164/58.1, 57.1; 420/25, 578
See application file for complete search history.

(56) References Cited

U.S. PATENT DOCUMENTS

| | | | | |
|---|---|---|---|---|
| 2,750,284 | A * | 6/1956 | Ihrig | 420/30 |
| 3,527,597 | A | 9/1970 | Dawson et al. | |
| 3,661,566 | A * | 5/1972 | Percheron et al. | 420/22 |
| 3,717,456 | A * | 2/1973 | Percheron et al. | 420/25 |
| 4,377,411 | A | 3/1983 | Moore | |
| 4,643,768 | A * | 2/1987 | Bruckmann et al. | 420/578 |
| 4,919,188 | A * | 4/1990 | Fessel et al. | 164/58.1 |
| 5,209,901 | A * | 5/1993 | Reifferscheid et al. | 420/578 |
| 6,102,983 | A * | 8/2000 | Skaland | 75/568 |
| 2004/0025980 | A1 | 2/2004 | Keller et al. | |

FOREIGN PATENT DOCUMENTS

| | | |
|---|---|---|
| DE | 1 239 715 | 5/1967 |
| EP | 0 805 216 B1 | 4/2003 |
| GB | 1 457 234 | 12/1976 |
| RU | 2 188 240 C1 | 8/2002 |
| SU | 1 724 715 A1 | 4/1992 |
| SU | 1 756 363 A1 | 8/1992 |

(Continued)

OTHER PUBLICATIONS

EPO Transmittal Sheet, Cabinet Germain & Maureau; "Received at the EPO on Sep. 30, 2009; p. 1 of 59"; (1 pg).

(Continued)

*Primary Examiner* — Devang R Patel
(74) *Attorney, Agent, or Firm* — Nixon & Vanderhye

(57) ABSTRACT

Process for producing ductile iron by treating liquid iron with an initializer which is a ferrosilicon alloy comprising an effective amount of barium sufficient to inactivate the oxygen activity of the liquid iron. This is followed at a predetermined time thereafter by treating the liquid iron with a magnesium containing nodularizer, followed by treating the liquid iron with a eutectic graphite nucleation-inducing inoculant, and casting the iron.

6 Claims, 5 Drawing Sheets

FOREIGN PATENT DOCUMENTS

| | | | |
|---|---|---|---|
| UA | 57819 | C2 | 7/2003 |
| WO | WO 95/24508 | | 9/1995 |
| WO | WO 95/24508 | A1 | 9/1995 |
| WO | WO 99/45156 | | 9/1999 |
| WO | WO 99/45156 | A1 | 9/1999 |

OTHER PUBLICATIONS

Letter (4 pgs), Observations by Third Party according to A.115 EPC; European Patent Application No. 07.252936.5 (EP 1 887 090) in the name of FOSECO International Limited.

Publication from AFS; AFS Cast Iron Inoculation Conferences, Sep. 29-39, 2005, Schaumburg, IL; Published 2005; Product No. FC0500 (17 pgs).

Article on EP 0 805 216; "Observations of the Gray Cast Iron Safety Casting Casted with Automatic Furnaces and Importance of the Preconditioning of the Melted Iron"; Conges Mondial De Fonderie; World Foundry Congress; Giesserei-Weltkongress; Sep. 2-18, 1998, Budapest, Hungary (10 pgs).

Essel Bakh, S.B. et al., Database CA (Online); "Dissolution and Assimilation of Iron Inoculants in Pouring Ladles", Accession No. 93:243546 abstract, (1980).

English Translation of Decision on Grant in Russian Patent Application No. 2008147892/02 (062723), filed Jun. 22, 2007, 8 pgs.

English Translation of Decision on Grant in Ukranian Patent Application No. 200813985/(MI-6175), filed Jun. 22, 2007, (4 pgs).

* cited by examiner

Figure 3 Nodule Count (s/mm2)
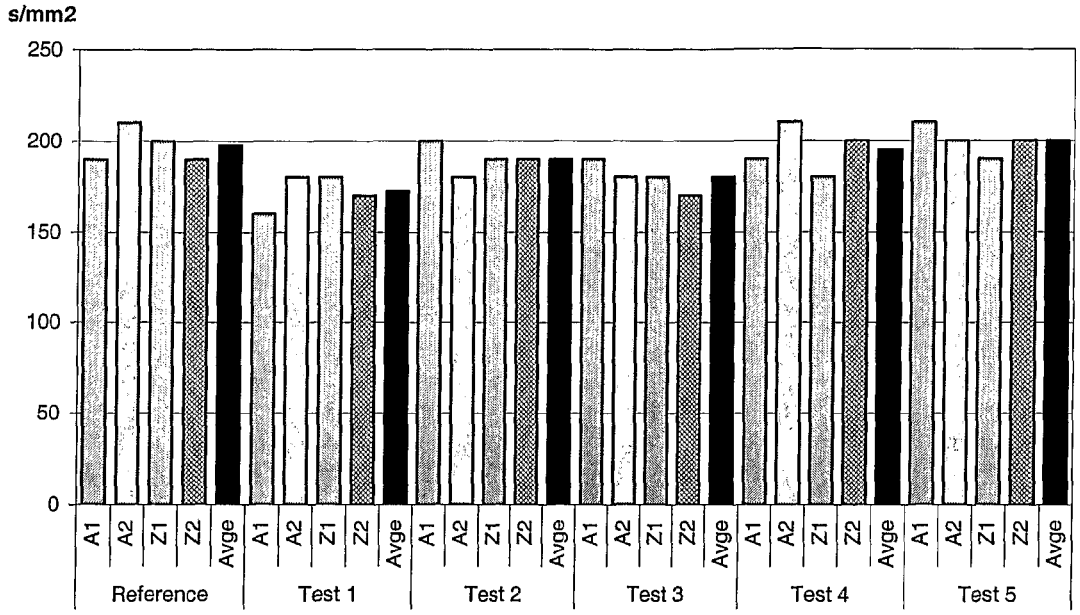
Figure 4 - Ferrite %
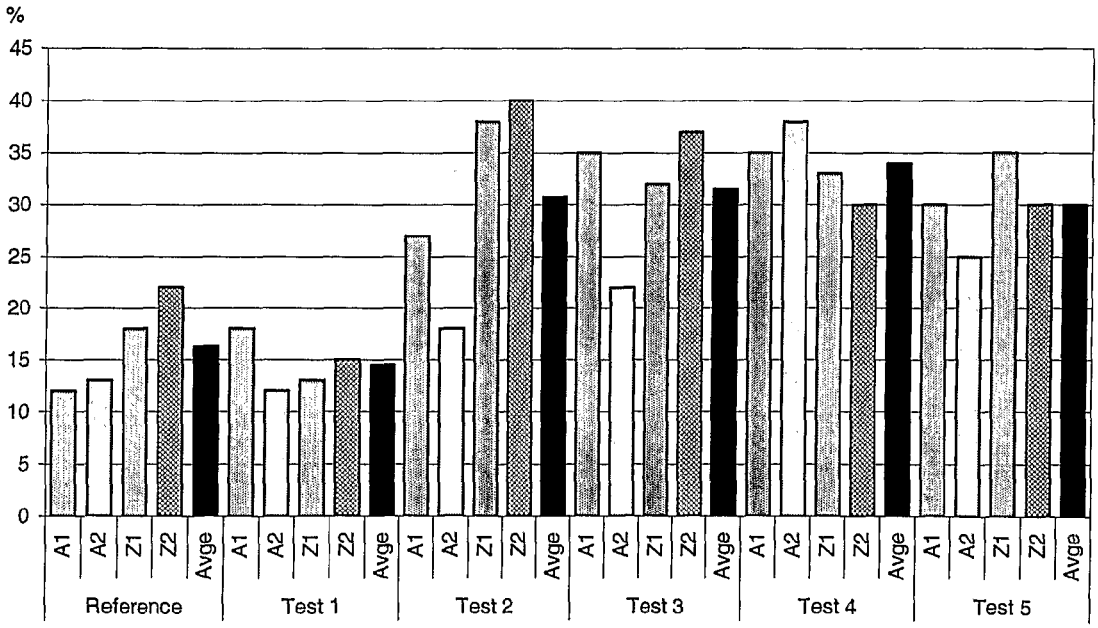

Figure 5 - Hardness (HB)
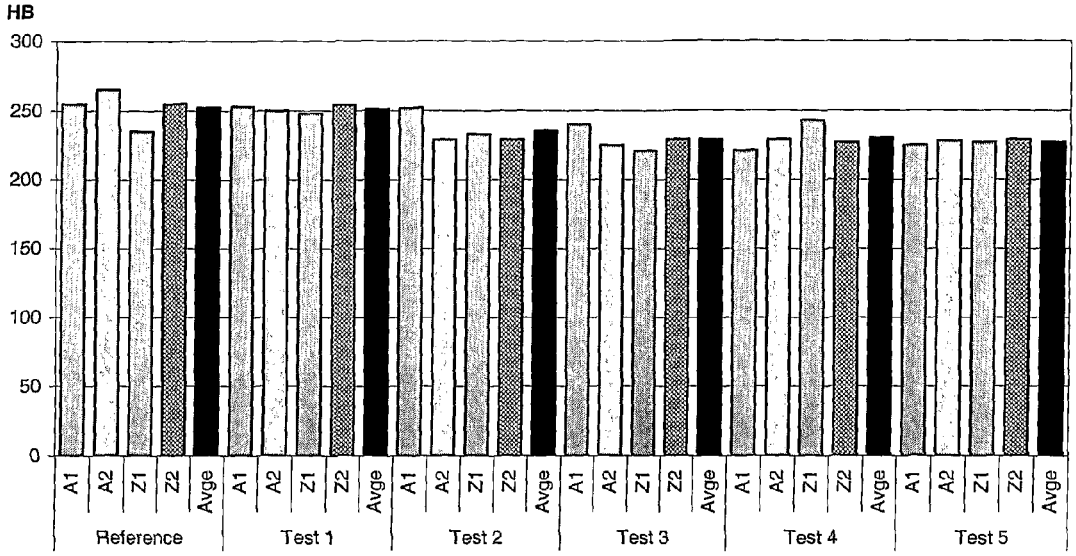
Figure 6 - Residual Mg %
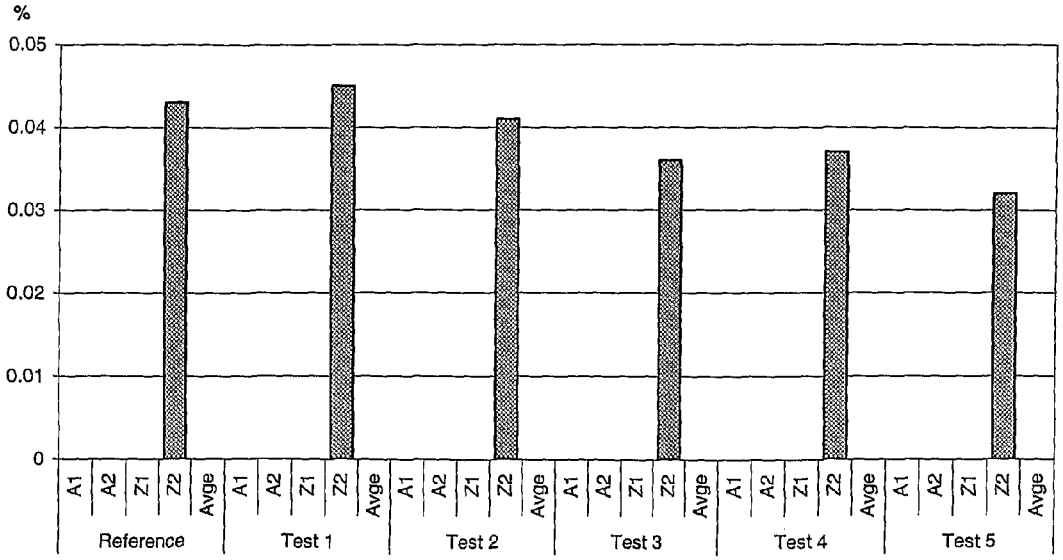

Figure 7 - Pinhole Promoters % (Al + Ti + Residual Mg)
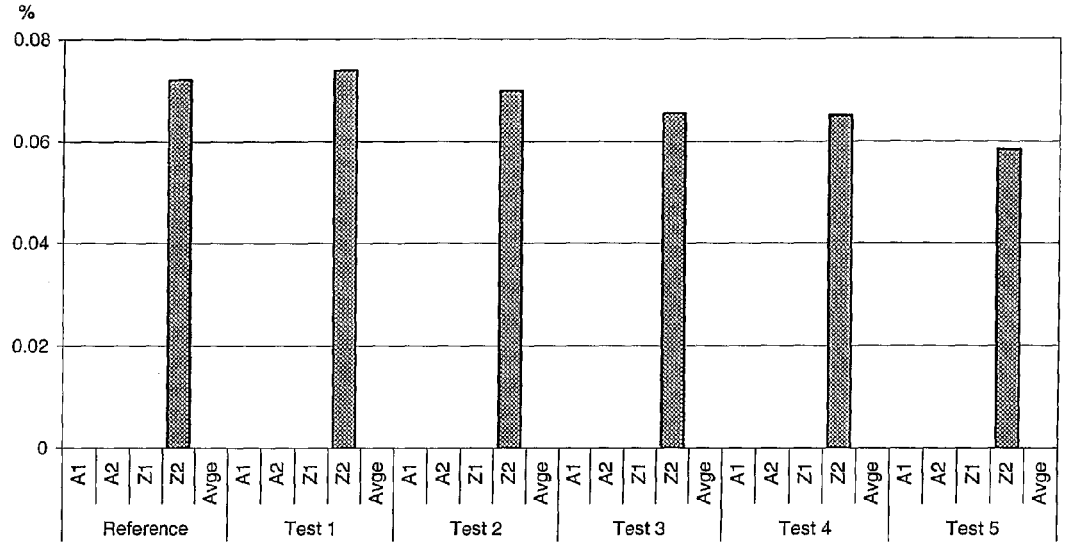
Figure 8 - Sulphur %
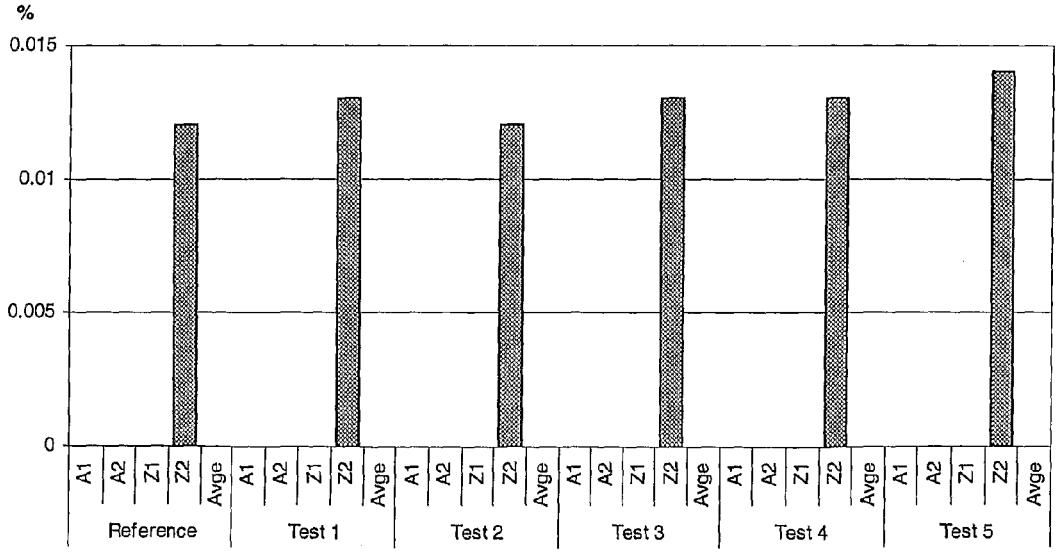

Figure 9 - Silicon %
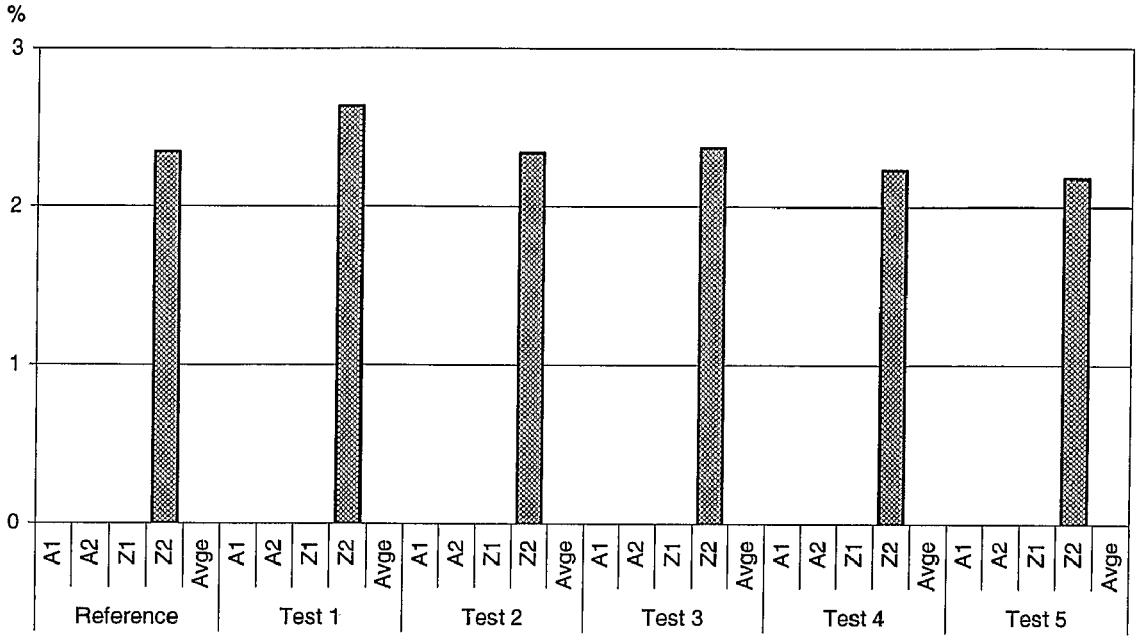

METHOD OF PRODUCING DUCTILE IRON

This application is the U.S. national phase of International Application No. PCT/GB2007/002342, filed 22 Jun. 2007, which designated the U.S. and claims priority to Great Britain Application No. 0614705.2, filed 25 Jul. 2006, the entire contents of each of which are hereby incorporated by reference.

BACKGROUND OF THE INVENTION

The present invention resides in a method of producing ductile iron.

In order to achieve the desired mechanical properties in iron castings, the liquid iron must have the correct composition and it must also contain suitable nuclei to induce the correct graphite morphology on solidification. The liquid iron must have a suitable 'graphitisation potential'. This is determined mainly by its "carbon equivalent value". It is normal practice to adjust the graphitisation potential by nucleation, e.g. by the controlled addition of so-called inoculants. Inoculants are mostly based on graphite, ferrosilicon or calcium silicide, with the ferrosilicon being the most commonly used.

Ductile iron, also known as spheroidal graphite (SG) iron or nodular iron differs from grey cast iron in that in the former, precipitation of graphite is in the form of discrete nodules instead of interconnected flakes. Promotion of precipitation of graphite into nodules is achieved by treating the liquid iron with a so-called nodulariser, commonly magnesium, prior to casting (and prior to inoculation). The magnesium may be added as pure metal, or more commonly as an alloy such as magnesium-ferrosilicon or nickel-magnesium. Other materials include briquettes such as "NODULANT" (TM), formed from granular mixtures of iron and magnesium, and hollow mild steel wire filled with magnesium and other materials. In general, the magnesium treatment should result in about 0.04% of residual magnesium in the liquid iron. There are however, a number of difficulties with this magnesium addition. Magnesium boils at a relatively low temperature compared to the liquid iron so there is a violent reaction due to the high vapour pressure of magnesium at the treatment temperature causing violent agitation of the liquid iron and considerable loss of magnesium in vapour form. In addition, during the treatment, oxide and sulphides are formed in the iron resulting in dross formation on the metal surface. This dross must be removed as completely as possible before casting. Also, residual magnesium in the liquid iron after treatment oxidises continuously at the metal surface where exposed to air, causing loss of magnesium which may affect the structure of the graphite spheroids, and the dross formed may result in harmful inclusions in the castings. The loss of magnesium to the atmosphere and in the formation of sulphides and oxides is variable and makes it difficult to predict the appropriate level of addition for a particular batch and also requires that the iron is 'overdosed' by as much as 100% or even more (50% or more of the magnesium may be lost). These factors are clearly disadvantageous in terms of cost, ease of handling and predictability in the mechanical properties and overall quality of the final castings.

Furthermore, magnesium is in fact a carbide promoter, so the level of inoculants required after magnesium treatment is relatively high. Since any scrap is generally returned to the beginning of the process for economic reasons, there is a tendency for the silicon content in the iron (derived from the inoculant and nodulariser additions) to rise over a period of time, limiting the proportion of scrap that can be used (the level of silicon required at the end of the process is predetermined by the specification for the casting). Attempts have been made to mitigate the issues involved with magnesium addition. For example, Foseco have combined the addition of magnesium nodulariser with an addition of a barium alloy (e.g. that sold under the tradename "INOCULIN 390" and having the following composition (by weight %) 60-67Si, 7-11Ba, 0.8-1.5Al, 0.4-1.7Ca, the balance being Fe). All compositions presented hereinafter are presented as weight % unless indicated otherwise. The use of such alloys can mitigate some of the issues outlined above but not in a reliable and predictable manner.

SUMMARY OF THE INVENTION

It is an objective of the present invention to provide an improved method of producing ductile iron which obviates or mitigates one or more of the problems associated with the prior art processes.

According to a first aspect of the present invention there is provided a process for the production of ductile iron comprising the sequential steps of:—

(i) treating liquid iron with an initialiser comprising an effective amount of a group Ha metal other than Mg, (ii) at a predetermined time after step (i), treating the liquid iron with a magnesium containing nodulariser, (iii) treating the liquid iron with a eutectic graphite nucleation-inducing inoculant, and (iv) casting the iron.

The present invention is based on the discovery that pretreating the iron with an initialiser prior to nodulariser addition results in a number of significant and surprising advantages.

Preferably, the Group Ha metal of the initialiser used in step (i) is Ba, Sr or Ca, and most preferably Ba.

Preferably, the initialiser of step (i) is a ferrosilicon alloy. More preferably, the ferrosilicon alloy is by weight percent 40-55Si, 5-15M, even more preferred is 46-50Si, 7-11M where M is the Group Ha metal (most preferably Ba), the balance being Fe and any unavoidable impurities which may be present.

The alloy may contain minor amounts of other alloying elements selected from one or more of the following: Al, Ca, Mn and Zr, for example independently, 0-2.5Al, preferably 0-1.5Al, 0-2Ca, 0-3Mn and 0-1.5Zr. When present, the minimum levels of such elements are preferably: 0.5Al, 1Ca, 2Mn and 0.5Zr.

A highly preferred alloy is 33.7-41.3Fe, 46-50Si, 7-11Ba, 0.01-1Al, 1.2-1.8Ca, 0.01-2.5Mn, 0.01-1Zr.

The Mg-containing inoculant used in step (ii) may be Mg metal (e.g. ingot or cored wire), MgFeSi alloy (preferably 3-20% Mg), Ni—Mg alloy (preferably 5-15% Mg), or Mg—Fe briquettes (preferably 5-15% Mg).

The treatment of step (ii) will conveniently be carried out between about 1 and 10 minutes after step (i). For practical reasons, 30 seconds is an absolute minimum, with at least 2 minutes after step (i) being particularly convenient. Most conveniently, step (ii) is conducted about 4 minutes after step (i).

Preferably, the amount of initialiser added in step (i) is calculated to deliver at least 0.035% of the Group Ha metal (by weight of the liquid iron). There is no particular problem with overdosing, but 0.04% (e.g. 0.4% of a 10% Ba containing initialiser) should be sufficient for most applications.

Normally, the level of Si in ductile iron is optimised to about 2.2-2.8%. At levels lower than this the proportion of ferrite is reduced and unacceptable levels of carbide are formed. The present process allows a reduction in the level of silicon by about 10 to 15%. Not only does this reduce the use and cost of adding silicon alloys to the iron, but advantageously, the impact resistance of the iron is increased as are the machining properties of the casting.

Preferably, the amount of Mg-containing nodulariser is calculated to result in about 0.03% (i.e. 0.025 to 0.035%) residual Mg in the liquid iron, i.e. a reduction of about 25% compared with a traditional process.

The specific nature of the inoculant of step (iii) is not significant and any known inoculant suitable for ductile iron may be used, for example inoculants based on, ferrosilicon (preferred) or calcium silicide.

According to a second aspect of the invention there is provided an initialiser for use in the production of ductile iron, said initialiser being a ferrosilicon alloy having the following composition in weight percent:—

40-55Si, 5-15M where M is a Group Ha metal other than Mg, preferably Ba, the balance being predominantly iron with optionally minor amounts (no more than 10 wt % total of Al, Ca, Mn and/or Zr and any unavoidable impurities.

The skilled person will be aware that the oxygen content of a base liquid iron will be related to its temperature (gas absorption rate), holding time, box weight and pace of the moulding line. Generally speaking, a slow running foundry process contains a low level of oxygen (eg. less than 40 ppm) and a fast running foundry process contains a high level of oxygen (e.g. greater than 80 ppm). The oxygen content has a direct bearing on the amount of magnesium that is required for nodularisation, since magnesium will combine with any oxygen present to form MgO, and only the free residual magnesium promotes nodularisation of graphite spheroids. Since the amount of oxygen is variable (and essentially unknown) it is impossible to dose the iron with the correct amount of magnesium. In those cases where the oxygen level is low, there will be an excessive amount of free magnesium. This results in promotion of carbide (hard phase) and increased gas defects and shrinkages. On the other hand where the oxygen level is high, there will be an excessive amount of MgO which results in un-rounded graphite spheroids, slag inclusions and surface defects.

The purpose of the initialiser is therefore to compensate for the variable oxygen levels by "resetting" or inactivating the oxygen activity. Since no magnesium is consumed in the formation of MgO on the subsequent magnesium addition, the required level of Mg addition can be much more accurately calculated. Since the required amount of Mg will inevitably be less than would have been used previously, the violence of the reaction is also reduced, further minimising the requirement to overdose. In any event a major advantage of the present invention is that the remaining parameters determining the level of Mg addition are either constant, can be predicted or be measured.

The sequential use of a Group Ha initialiser and magnesium nodulariser is particularly effective. Experience has shown that magnesium is by far the best material for inducing the graphite nodules to grow in the required spheroid shape. However, Mg is far from ideal in its other properties: it reacts more violently than the other members of the Group, its oxide is less stable, it has a high fading tendency, it forms large amounts of "sticky" silicate slags which promote defects in the final castings and it is not particularly good at nucleating the initial formation of the graphite nodules. Moving down the Group from Ca to Sr and Ba, the reaction violence is reduced, the stability of the oxides increases, fading tendency reduces and nucleation power increases. In addition, the slags tend to be oxides rather than silicates and are easier to separate from the iron.

It will be appreciated that whether the oxygen in the iron is consumed by Mg or by the initialiser (preferably Ba), it's level is still unknown, so overdosing is still required. However, the consequences of overdosing with the initialiser are not nearly as disadvantageous as overdosing with Mg, since the Group Ha metal of the initialiser is less carbide promoting than Mg and produces easier to handle slag.

Although all of the Group Ha metals will be beneficial in terms of deoxidising the melt, the use of Ba is particularly advantageous. Where excess initialiser is used, the relatively small nuclei will gather together, thereby increasing their surface area and the flotation mechanism takes over, so that the excess is removed as slag (in other words, unlike Mg where the amount of free Mg in the residual Mg may vary, this is not a variable in the as cast component). In other words, the invention can be seen as a way of converting a metallurgical variable (oxygen level) that manifests itself as variability in the as-cast component to a process variable (oxygen-based slag) that is a parameter of the process and completely separate from the as-cast component. Elements above barium in the periodic table will have a tendency to fade more quickly since they are lighter and will float out more rapidly. Elements below Ba (i.e. Ce) will tend to sink to the bottom of furnaces/ladles. On the other hand BaO has about the same density as liquid iron, so the opportunity to maximise and obtain homogeneity in the nucleation process is only realised with Ba.

BRIEF DESCRIPTION OF THE DRAWINGS

Embodiments of the invention will now be described with reference to the accompanying drawings in which:—

FIGS. 3 to 9 are plots of nodule count, % ferrite, hardness, residual Mg %, % pinhole promoters, % sulphur and % silicon respectively for cast samples from a foundry trial comparing a prior art Mg treatment with processes in accordance with the present invention.

DETAILED DESCRIPTION OF PREFERRED EMBODIMENTS

Figure 1:
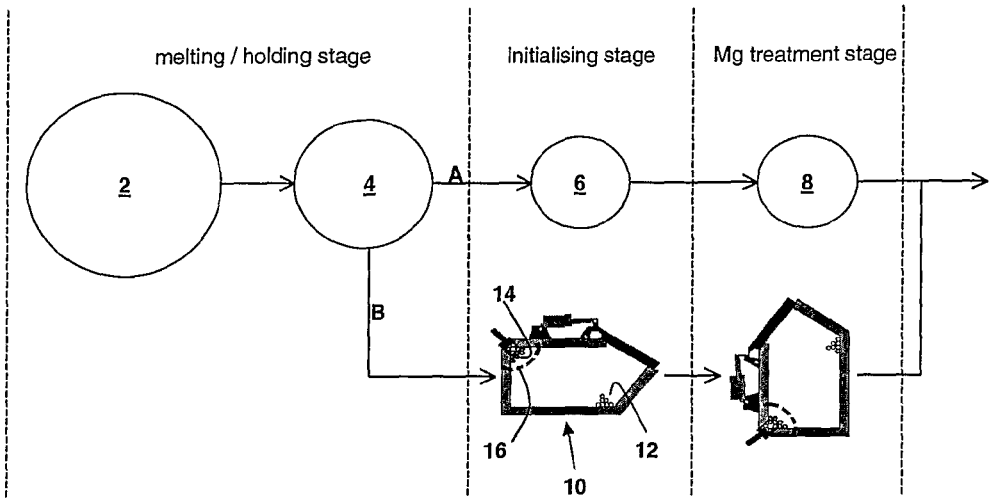
FIG. 1 is a schematic representation of a foundry set up for practising the method of the present invention.

Referring to FIG. 1, a schematic arrangement for carrying out the process of the present invention is shown. The base iron is melted in a furnace 2 and transferred to a holder 4 (route A). The molten iron is then poured into a first (initialising) ladle 6, which has been predosed with the initialiser. It is important to maintain a suitable temperature for favouring the formation of barium oxides and, depending on the exact set up, this can be achieved by "overheating" the holding furnace 4 where there is no temperature control of the first ladle 6 (to account for the holding time in the first ladle 6) or by using a heated first ladle 6. The initialised iron is then poured into a second ladle 8 which is predosed with the nodulariser (alternatively, the nodulariser may be added to the initialised iron, e.g. by plunger method or as cored wire). The metal can then be treated in a conventional fashion in terms of inoculation, pouring etc.

In route B, essentially the same process is carried out in a single vessel, such as a GF converter ladle 10. A GF converter ladle is essentially a large vessel lined with refractory which is tiltable by 90°. When the converter 10 is arranged to receive the charge of molten iron, the initialiser 12 is dosed on the floor of the converter and the nodulariser 14 is retained in a pocket formed between a sidewall and roof of the converter ladle 10 by a so-called Salamander plate 16, so that in this position, the nodulariser remains above the iron charge. Once initialisation has taken place, the converter is tilted by 90° so that the nodulariser is now between the floor and the sidewall of the converter ladle in its tilted position. Liquid iron penetrates the pocket and nodularisation is effected.

Foundry Trial 1: Ductile Iron Pipe Manufacture Case Study

A significant amount of ductile iron production is devoted to the manufacture of pipes, eg. for mains water or waste water systems. Ductile iron pipes offer all the benefits of cast (grey) iron but are stronger, more durable and flexible. For a given internal bore, a ductile iron pipe can be made thinner, lighter and consequently more cheaply than a cast iron equivalent.

Existing Process

The foundry has a blast furnace producing 700 t/day of base iron of which 50% is sold as pig-iron and 50% used in the pipe plant. The pig iron used for the pipe making is supplemented with 10% scrap steel (5% CRCA low Mn steel and 5% Mn steel). The pipe plant operates using a standard rotating permanent pipe mould. The silicon content of the iron is adjusted using FeSi75 (0.15%) in a holding furnace prior to tapping into a GF converter. The nodulariser treatment is conducted using pure Mg, at an addition rate of 0.12% by weight of Mg. Late stream inoculation is carried out using ZIRCOBAR-F(TM) whose composition (excluding Fe) is Si60-65, Ca1-1.5, Al1-1.6, Mn3-5, Zr2.5-4.5, Ba2.5-4.5 (0.15%) and 0.35% mould powder (INOPIPE E04/16(TM), whose composition (excluding Fe) is Si57-63, Ca13-16, Al0.5-1.2, Ba0.1-0.5, Mg0.1-0.4) is also used during pipe formation.

Modified Process in Accordance with the Invention

Figure 2:
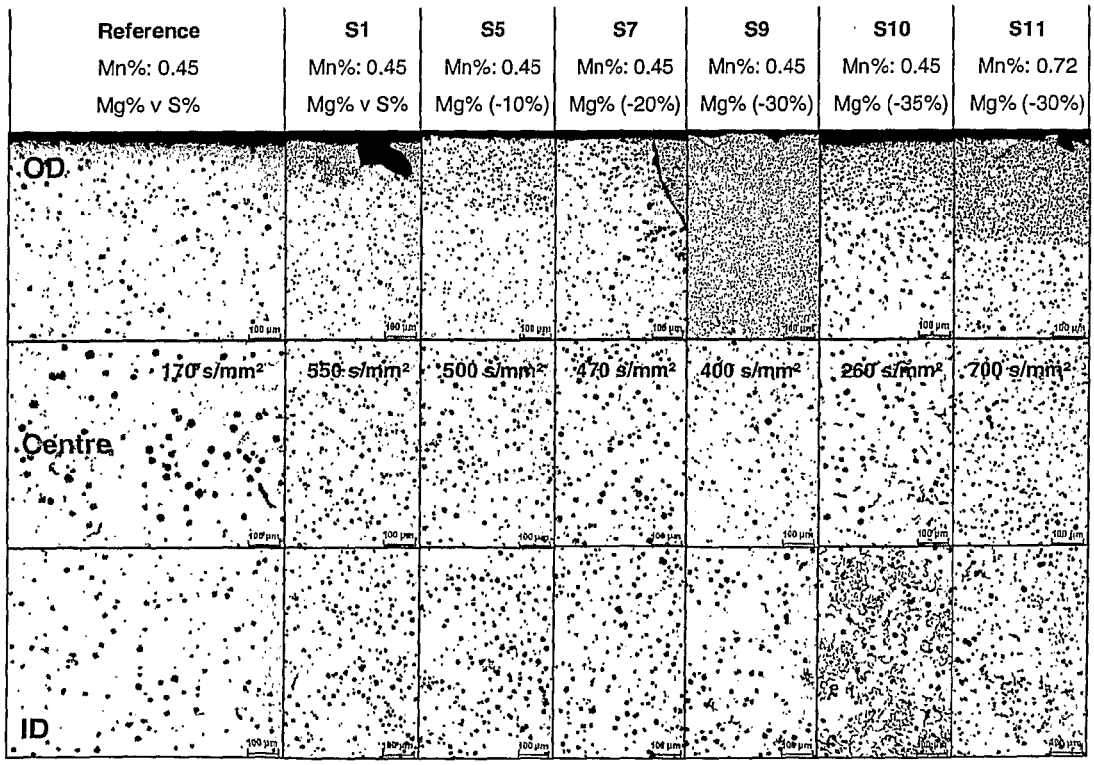
FIG. 2 shows optical micrographs of iron samples prepared in accordance with the present invention in comparison to a prior art sample.

The above process was modified to include an initialisation stage of treatment with INOCULIN 390 (60-67Si, 7-11Ba, 0.8-1.5Al, 0.4-1.7Ca, the balance being Fe and trace impurities), applied at a rate of 0.4% by weight, 4 minutes prior to the Mg treatment. Metallographic studies were made on sections through the pipes produced to investigate the graphite precipitation in the iron. Further modifications of the process were conducted by stepwise reduction in the level of magnesium treatment after initialisation. The results are shown in FIG. 2 which shows sections through various 9 mm pipes from the outside surface of the pipe (OD) through the centre to the inside surface of the pipe (ID). The Mn content of the iron was 0.45% and the significance of the Mn content will be discussed below.

The first column of FIG. 2 ("Reference") shows the results of carrying out the standard process. The graphite nodules (grey spots) are clearly visible and were present in the centre section at a frequency of 170/mm$^2$. The initialisation treatment (column 2 "S1") resulted in a significant increase in graphite nodules (550/mm$^2$). The next four panels show the effect of reducing the Mg relative to "Reference" by 10% ("S5"), 20% ("S7") 30% ("S9") and 35% ("S10"). As the level of magnesium is reduced, so does the number of nodules (S5—500/mm$^2$, S7—470/mm$^2$, S9—400/mm$^2$ and S10—260/mm$^2$). All of these values are higher than the reference treatment. Only in the S10 sample (Mg reduction 35%) is the graphite beginning to precipitate as flakes rather than nodules towards the inner surface of the pipe.

The end panel in FIG. 2 ("S11") shows the effect of the initialisation treatment at 30% reduced Mg addition on an iron having a relatively high Mn content (0.72%). Mn is a carbide promoter and previous experience had shown that the maximum Mn content that the pipe plant could handle using the standard processing was 0.5%. The S11 sample shows excellent graphite nodularisation and indicates that higher Mn content is now processable in the pipe plant. This allows the foundry to use the cheaper Mn steel scrap. In addition, although not directly relevant to the pipe making process, the higher Mn content of the iron increases the value of the pig iron produced by this foundry.

A further advantage of the present process is that it allows a significant reduction in the use of inoculant, since there is less Mg present (strong carbide promoter). Not only does this reduce costs, but it reduces the amount of silicon added to the iron. This in turn allows a higher proportion of scrap to be returned to the furnace. It is also anticipated that the FeSi addition into the holding furnace can be omitted completely—since there is less carbide promoting Mg present, a lower compensatory level of Si can be tolerated in the iron.

On the basis of the above trial, it is anticipated that a reduction in the level of Mg by 28% from the reference will be well tolerated and that both late stream inoculant and mould powder usage can be reduced by 20%.

Mg, and Al and Ti impurities in the Mg alloys used, react with water to produce oxides and hydrogen gas which is responsible for pinhole formation. The entrainment of Mg slag in the iron introduces areas of weakness in the pipe which can lead to leakages under pressure. The reduction in the Mg loading reduces the amount of Mg slag produced and this in turn reduces the amount of slag entrained in the iron. It is reasonably anticipated that adoption of the above process will reduce the rate of pinhole formation and leakages by 50%. Calculations have indicated that this foundry could increase its profit margin on pipe production by about 50% by adopting the inventive process.

The process of the present invention allows the more efficient production of thinner pipes. It will be understood that thinner pipes will not only cool more rapidly which affects the morphology of the iron, but any defects in the iron are more likely to result in leakages.

Foundry Trial 2: Ductile Iron Castings

Existing Process ("Reference")

Iron was melted in an arc furnace and subsequently transferred to a holding furnace. FeSi75 was added prior to Mg treatment (FeSi44-48Mg6) (0.9%) in a GF converter). A cerium tablet (0.1%) was also added to deoxidise the melt. For each ladle a series of moulds were poured, in the Figures "A" representing the first mould poured and "Z" representing the last mould poured. Each mould produced two identical castings (medium-thick section automotive part) labelled "1" and "2". Late stream inoculation was conducted using INOLATE 40(TM) (70-75Si, 1.0-2.0Ca, 0.7-1.4Al, 0.8-1.3Bi, 0.4-0.7 Rare Earths, the balance being Fe and trace impurities) (0.03%).

Modified Process in Accordance with the Present Invention

A series of tests were conducted based on the reference process. In test 1, initialisation was carried out 4 minutes prior to Mg treatment (cerium tablet omitted) using INOCULIN 390 (60-67Si, 7-11Ba, 0.8-1.5Al, 0.4-1.7Ca, the balance being Fe and trace impurities). In test 2 to 5, the Mg nodulariser was reduced stepwise by approximately 11% (Test 2), 15% (Test 3), 19% (Test 4) and 26% (Test 5).

The relevant parameters for the process are shown in Table 1 below.

TABLE 1 process parameters for Foundry Trial 2

| | Ladle Charge | Inoculation FeSi75 | Initialisation INOCULIN 390 | | Mg Treatment FeSiMg | | |
|---|---|---|---|---|---|---|---|
| Sample | Wt (kg) | Wt (kg) | Wt (kg) | % addition | Wt (kg) | % addition | % Saving |
| Reference | 650 | 2 | 0 | 0.00 | 6.0 | 0.92 | 0.0 |
| Test 1 | 660 | 0 | 2.6 | 0.39 | 6.0 | 0.91 | 0.0 |
| Test 2 | 670 | 0 | 2.6 | 0.39 | 5.4 | 0.81 | −11.3 |
| Test 3 | 660 | 0 | 2.6 | 0.39 | 5.1 | 0.77 | −15.0 |
| Test 4 | 650 | 0 | 2.6 | 0.40 | 4.8 | 0.74 | −18.8 |
| Test 5 | 670 | 0 | 2.6 | 0.39 | 4.5 | 0.67 | −26.1 |

The results are shown graphically in FIGS. 3 to 9. Metallurgical properties were measured on casting sections and metallurgical compositions were measured on chill samples taken from each ladle after pouring the last mould.

Referring to FIG. 3, it can be seen that the reduction in the level of Mg does not have a negative impact on the nodule count. At the same time there is a noticeable increase in the percentage of ferrite in the castings (FIG. 4) with a corresponding reduction in hardness (FIG. 5). This is not in itself necessarily desirable, particularly if the same mechanical properties as the reference are required. However, the inherent increase in ferrite allows the use of more alloying elements (eg. Mn) in the initial charge which tend to promote carbide formation (such alloying elements can be ones specifically chosen for enhanced characteristics or ones merely present as impurities in the charge). As would be expected, the level of residual Mg is lowered (FIG. 6) and the number of pinhole promoters (Al+Ti+Mg) is also reduced (FIG. 7). FIG. 8 shows an increase in the level of S in the castings as the Mg level is reduced. This is because, like oxygen, sulphur combines with barium in the initialisation treatment and is unavailable to combine with magnesium during the nodularisation treatment. Unlike MgS, BaS is not taken out of the melt as slag, but remains in the iron. A higher level of sulphur improves machining properties. From FIG. 9 it can be seen that all the advantages previously described are obtained despite the level of Si being reduced.

It is anticipated that further optimisation would include the reduction of in-mould inoculant required and allow the production of castings with at least comparable mechanical properties to the reference process more cheaply and more consistently.

Foundry Trial 3: Large Ductile Iron Castings

Existing Process ("Reference")

An induction furnace was charged as follows:

Steel 45%
Pig iron 15%
Returns 40%
SiC 6 Kg/t
C 3.5 Kg/t
Cu 2 Kg/t and the charge melted. The first three ladles (1100 Kg) were used for the reference (representative data given for a single ladle only) and the fourth ladle for the inventive process. FeSi75 (0.4%) was added prior to Mg treatment (FeSi44-48Mg6) (1.5%) in ladle. Late stream inoculation was conducted using INOLATE 190 (TM) (62-69Si, 0.6-1.9Ca, 0.5-1.3Al, 2.8-4.5Mn, 3-5Zr, <0.6 Rare Earths, the balance being Fe and trace impurities) (0.08%). In mould inoculation used GERMALLOY insert (supplied by SKW, approximate composition Si65, Ca1.5, A14, balance Fe) (0.1%). Metallurgical and mechanical properties of the resulting castings were determined.

Modified Process in Accordance with the Present Invention

Prior to pouring, 0.45% INOSET (TM) 48Si, 9.4Ba, 2.4Al, 1.4Ca, 1.6Mn, 2.4Zr (balance Fe and trace impurities) was added to the furnace. The pre-treated charge (1400 Kg) was poured into the ladle containing FeSi44-48Mg6 (1.2%) with no FeSi75 addition 4 minutes after the INOSET dosing. Late stream inoculation was conducted using INOLATE190 (0.13%) with no GERMALLOY insert in the mould.

There was no material difference in the metallurgical or mechanical properties (tensile strength, tensile yield, elongation at break %) between the two methods. However, the use of less Mg in the inventive process permits a reduction in the final Si content (for reasons described earlier) which improves machining properties.

The efficiency of the processes can be compared by determining Mg recovery (defined as the proportion of residual Mg in the casting to the total Mg added). The reference process has an Mg recovery of 46.6% and the inventive process 61.1%.

The inventive process allows the production of castings having a comparable metallic matrix and mechanical properties with a much more consistent and efficient Mg treatment.

The invention claimed is:

1. A process for the production of ductile iron comprising:

treating liquid iron with an initialiser which is a bariumferrosilicon alloy wherein the bariumferrosilicon alloy delivers an amount of barium effective to deoxidize the iron through the formation of barium oxides, followed at least two minutes thereafter by treating the liquid iron with a magnesium containing nodulariser, followed by treating the nodularized liquid iron with a eutectic graphite nucleation-inducing inoculant, and casting the iron.

2. A process as claimed in claim 1, wherein the bariumferrosilicon alloy is by weight percent 46-50Si, 7-11 Ba the balance being Fe and any unavoidable impurities which may be present.

3. A process as claimed in claim 1, wherein the Mg-containing nodulariser (ii) is Mg metal, MgFeSi alloy, Ni—Mg alloy, or Mg—Fe briquettes.

4. A process as claimed in claim 1, wherein treatment with the Mg-containing nodulariser is carried out between about 1 and 10 minutes after treatment with the initialiser.

5. A process as claimed in claim 1, wherein, the amount of initialiser added is calculated to deliver at least 0.035% barium by weight of the liquid iron.

6. A process as claimed in claim 1, wherein the amount of Mg-containing nodulariser is calculated to result in from 0.025 to 0.035% residual Mg in the liquid iron.

* * * * *